US009067751B2

(12) United States Patent
Haapanen

(10) Patent No.: US 9,067,751 B2
(45) Date of Patent: Jun. 30, 2015

(54) WINDING SECTION IN A SLITTER WINDER FOR A FIBROUS WEB AND APPARATUS FOR BRINGING A FASTENING MEANS ONTO THE SURFACE OF A PARTIAL WEB

(75) Inventor: Jaakko Haapanen, Järvenpää (FI)

(73) Assignee: Valmet Technologies, Inc., Espoo (FI)

( * ) Notice: Subject to any disclaimer, the term of this patent is extended or adjusted under 35 U.S.C. 154(b) by 329 days.

(21) Appl. No.: 13/518,247

(22) PCT Filed: Dec. 17, 2010

(86) PCT No.: PCT/FI2010/051054

§ 371 (c)(1), (2), (4) Date: Jun. 21, 2012

(87) PCT Pub. No.: WO2011/076997

PCT Pub. Date: Jun. 30, 2011

(65) Prior Publication Data

US 2012/0255679 A1 Oct. 11, 2012

(30) Foreign Application Priority Data

Dec. 22, 2009 (FI) ..... 20090469 U

(51) Int. Cl.
*B65H 19/29* (2006.01)
*B65H 19/28* (2006.01)

(52) U.S. Cl.
CPC ..... *B65H 19/29* (2013.01); *B65H 19/286* (2013.01); *B65H 2301/414421* (2013.01); *B65H 2301/414436* (2013.01); *B65H 2301/414443* (2013.01); *B65H 2301/4148* (2013.01); *B65H 2402/32* (2013.01)

(58) Field of Classification Search
None
See application file for complete search history.

(56) References Cited

U.S. PATENT DOCUMENTS

| | | | | |
|---|---|---|---|---|
| 3,546,898 | A * | 12/1970 | Langlois et al. | 65/377 |
| 4,494,480 | A | 1/1985 | Salmela et al. | |
| 4,775,110 | A | 10/1988 | Welp et al. | |
| 4,895,315 | A | 1/1990 | Salmela et al. | |
| 5,679,408 | A | 10/1997 | Eronen | |
| 2003/0160127 | A1 * | 8/2003 | Wojcik et al. | 242/531 |

FOREIGN PATENT DOCUMENTS

| | | |
|---|---|---|
| FI | 64114 | 6/1983 |
| FI | 65554 | 2/1984 |

(Continued)

OTHER PUBLICATIONS

International Search Report for PCT/FI2010/051054 dated Mar. 23, 2011.

(Continued)

*Primary Examiner* — Barbara J Musser
(74) *Attorney, Agent, or Firm* — Stiennon & Stiennon

(57) ABSTRACT

The present invention relates to a winding section (10) and to an apparatus (20) in a slitter winder for bringing a fastening means onto the surface of each partial web (w'). The apparatus (20) has an applicator head (22, 22'), which is arranged to apply the fastening means onto the web surface. The apparatus (20) has support members (24) by means of which the apparatus can be mounted into the slitter winder and by means of which the apparatus (20) can be arranged movably substantially in a cross-direction with respect to the slitter winder.

16 Claims, 5 Drawing Sheets

(56) References Cited

FOREIGN PATENT DOCUMENTS

| | | | |
|---|---|---|---|
| FI | 69617 | | 11/1985 |
| FI | 91054 | | 1/1994 |
| FI | 100024 | B2 | 11/1995 |
| WO | 2008113889 | A2 | 9/2008 |
| WO | 2008148937 | A1 | 12/2008 |
| WO | 2011076997 | A1 | 6/2011 |

OTHER PUBLICATIONS

Written Opinion of the International Searching Authority for PCT/FI2010/051054 dated Mar. 23, 2011.
International Preliminary Report on Patentability for PCT/FI2010/051054 dated Jun. 26, 2012.

* cited by examiner

WINDING SECTION IN A SLITTER WINDER FOR A FIBROUS WEB AND APPARATUS FOR BRINGING A FASTENING MEANS ONTO THE SURFACE OF A PARTIAL WEB

CROSS REFERENCES TO RELATED APPLICATIONS

This application is a U.S. national stage application of International App. No. PCT/FI2010/051054, filed Dec. 17, 2010, the disclosure of which is incorporated by reference herein, and claims priority on Finnish App. No.U20090469, filed Dec. 22, 2009.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a winding section of a slitter winder for a fibrous web in which an apparatus for bringing a fastener onto the surface of each partial web is arranged along the path which the partial web travels before the winding section. The invention also relates to an apparatus for a slitter winder for a fibrous web for bringing a fastener onto the surface of a partial web.

A machine roll formed on a paper machine, or generally on a fiber web machine, is often slit in a slitter winder into partial webs in order to form customer rolls of required width, i.e. commercial rolls. Automatic fastening of the cut end, i.e. the web tail, of the commercial rolls formed on the slitter winder and gluing of the leading end of the web onto the core, are nowadays ever more important steps in the further handling of the fibrous web. Firstly, this is due to the fact that today less and less personnel work at the same time on the slitter winder, and reel changes, tail threading and other compulsory measures take so much of their working time that there is hardly any time left for manual fastening of the web tails/leading ends of the reels by tape or the like. Further, the reels, the tails of which are not fastened cause trouble on the conveyors, and another problem is that the reel has time to slacken before it is wrapped.

To solve this problem, there are some prior art solutions, in which a device for applying an adhesive on the face of the paper web, as long as required, while the slitter winder is slowing down and stopping for a set change, is adapted in conjunction with the reel-up after the slitter winder. As far as this prior art technology is concerned, reference is made to patents Fl 64114, FI 65554 and FI 69617. In the solutions known from these patent documents, the application of the adhesive on the web surface is performed by a tube of the same width as the machine, the tube being provided with holes bored at uniform intervals for extruding the adhesive. In this known device, the cleaning of the applicator head for the adhesive is problematic. Further, the nozzles of the applicator tube have been cleaned manually, which is industrious and time-consuming. In addition, the access to this kind of a device is difficult, as the device is typically located underneath the web, inside the slitter winder.

There are various kinds of solutions for gluing and/or fastening the web tail by a machine. As for the prior art, reference is also made to the patent Fl 91054, where a method and a device for automatic cut-off and winding of a material web are disclosed. In this document, also a solution for gluing the web tail is disclosed, wherein the web is weakened and the weakened point is provided with a trace of glue, which is passed onto the web surface by glue-spraying nozzles.

Further, the document FI100024 discloses a device for the application of an adhesive or equivalent onto a moving material web, which device comprises frame constructions, an adhesive-applicator head, a container space, means for transferring the applicator head into the container space and at least one nozzle for the adhesive, which is also arranged in the vicinity of the material web, i.e. underneath it.

Generally, the devices for gluing and/or fastening the web tail are typically placed inconveniently in terms of maintenance, and in addition, the maintenance of the devices can be even dangerous to perform, especially when the slitter winder is running, for instance when winding a set.

SUMMARY OF THE INVENTION

An object of the present invention is to provide a winding section for a slitter winder, by which the afore-mentioned problems can be minimized.

An object of the present invention is also to provide an apparatus in a slitter winder for a fibrous web for bringing a fastening means onto the surface of each partial web, by which apparatus the afore-mentioned problems can be minimized.

The objects of the invention are achieved by a winding section in a slitter winder for a fibrous web, where an apparatus for bringing a fastening means onto the surface of each partial web is arranged along the travel path of the web before the winding section, the apparatus comprising an applicator head, which is arranged for applying the fastening means onto the surface of each partial web. Support members are arranged in conjunction with the winding section, by means of which members the apparatus for bringing the fastening means is arranged movably substantially in the cross-direction with respect to the winding section.

An apparatus of this kind can maximize especially the reliability of the applicator head. Thus, the fastening of the cut end of commercial rolls, i.e. the end of the wound web, after the winding, and the gluing of the leading end of the web to be wound onto the core is provided reliably.

According to an embodiment of the invention, an end point, i.e. an L-shape, in the cross-direction of the web is provided in the traces of the fastening means that are located in the travel direction of the web. This can be performed for instance at the end stage of the passing of the fastening means by moving the whole apparatus for bringing the fastening means in a cross-direction relative to the travel direction of the web. The transverse movement may be, e.g., about 50 mm. In this manner, the web tail can be fastened onto the reel surface more efficiently than before and thereby the fastening method prevents better the reel from opening. This is particularly suitable when the apparatus is a gluing apparatus, whereby the fastening means is an adhesive.

Locking members are preferably arranged in conjunction with the apparatus, by means of which members the apparatus for bringing the fastening means can be locked at least into its operating position.

In this way, the access to the apparatus is improved significantly, since it can be moved from the operating position to the maintenance position by means of the support members.

According to an advantageous embodiment, the applicator head extends across all the partial webs and is fixedly adapted in the apparatus. This being the case, especially, the solution according to the invention is very advantageous, since it facilitates the maintenance work. The applicator head is preferably a gluing device and in this embodiment it comprises a number of successive glue nozzles substantially in the entire region of the partial webs. The gluing device is preferably arranged to pass the adhesive onto the web surface at the final stage of the winding in order to fasten the tail of the cut-off web onto the web surface and/or to fasten the new web onto the core base, e.g. a sleeve, of the reel.

According to another embodiment, the apparatus comprises a first guiding structure extending in the slitter winder essentially in cross-direction across the partial webs, in which guiding structure the applicator head is movably arranged. In this case, the support members comprise, according to one embodiment, a second guiding structure, into which the first guiding structure is arranged. The first guiding structure can preferably be locked in its operating position with respect to the second guiding structure.

According to another embodiment, the support members comprise a number of support wheels, carried by which the first guiding structure is movably arranged. The support wheels may also form a part of the second guiding structure.

The support members extend across the partial webs essentially in a cross-direction in the slitter winder, whereby the apparatus can in its operating position apply the fastening means on all the partial webs.

Preferably, the apparatus is a gluing apparatus, whereby the fastening means is an adhesive. Then, the applicator head is provided with supply equipment for the adhesive.

The objects of the invention are also achieved by an apparatus for the slitter winder for a fibrous web for bringing a fastening means onto the surface of each partial web, which apparatus comprises an applicator head, which is arranged to apply the fastening means onto the surface of the web. The invention is characterized in that the apparatus comprises support members, by means of which the apparatus can be mounted into the slitter winder and by means of which support members the apparatus for bringing the fastening means can be arranged movably substantially in the cross-direction with respect to the slitter winder.

Locking members are preferably arranged in conjunction with the apparatus, by means of which members the apparatus for introducing the fastening means can be locked at least into its operating position with respect to the support members.

According to an embodiment, the applicator head of the apparatus extends across the partial webs and is fixedly adapted in said apparatus. According to another embodiment, the apparatus comprises at least an elongated first guiding structure, in which the applicator head is arranged to move so that it can move across the partial webs, when the apparatus is adapted in the slitter winder. According to an embodiment, the support members comprise a second guiding structure, in which the first guiding structure is arranged.

According to another embodiment, the support members comprise a number of support wheels, in which the first guiding structure is arranged.

According to yet another embodiment, the second guiding structure comprises a number of support wheels, carried by which the first guiding structure is arranged to be moved.

According to an embodiment, the apparatus may consist of a structure that can be separated into two parts. The parts of the structure are arranged movably to different sides of the slitter winder, i.e. along the sides thereof, by means of the support members. Thus, one part of the apparatus may be moved to the tending side of the slitter winder and the other part to the drive side thereof, whereby not as much space is required at the side of the slitter winder as in the case, if the apparatus were moved in one piece. The apparatus may also be, e.g., a three-part structure, whereby the point, where the apparatus is separated into two parts may vary. Then, the middle section in the three-part structure may be moved together with one of the outer sections, as is required, either to the tending side or to the drive side.

The support members extend across the partial webs essentially in cross-direction, when the apparatus is adapted in the slitter winder.

Other, additional characteristic features of the invention are disclosed in the appended claims and in the following description of the embodiments shown in the figures.

BRIEF DESCRIPTION OF THE DRAWINGS

In the following, the invention and its operation will be explained with reference to the appended schematic drawings.

DESCRIPTION OF THE PREFERRED EMBODIMENTS

Figure 1:
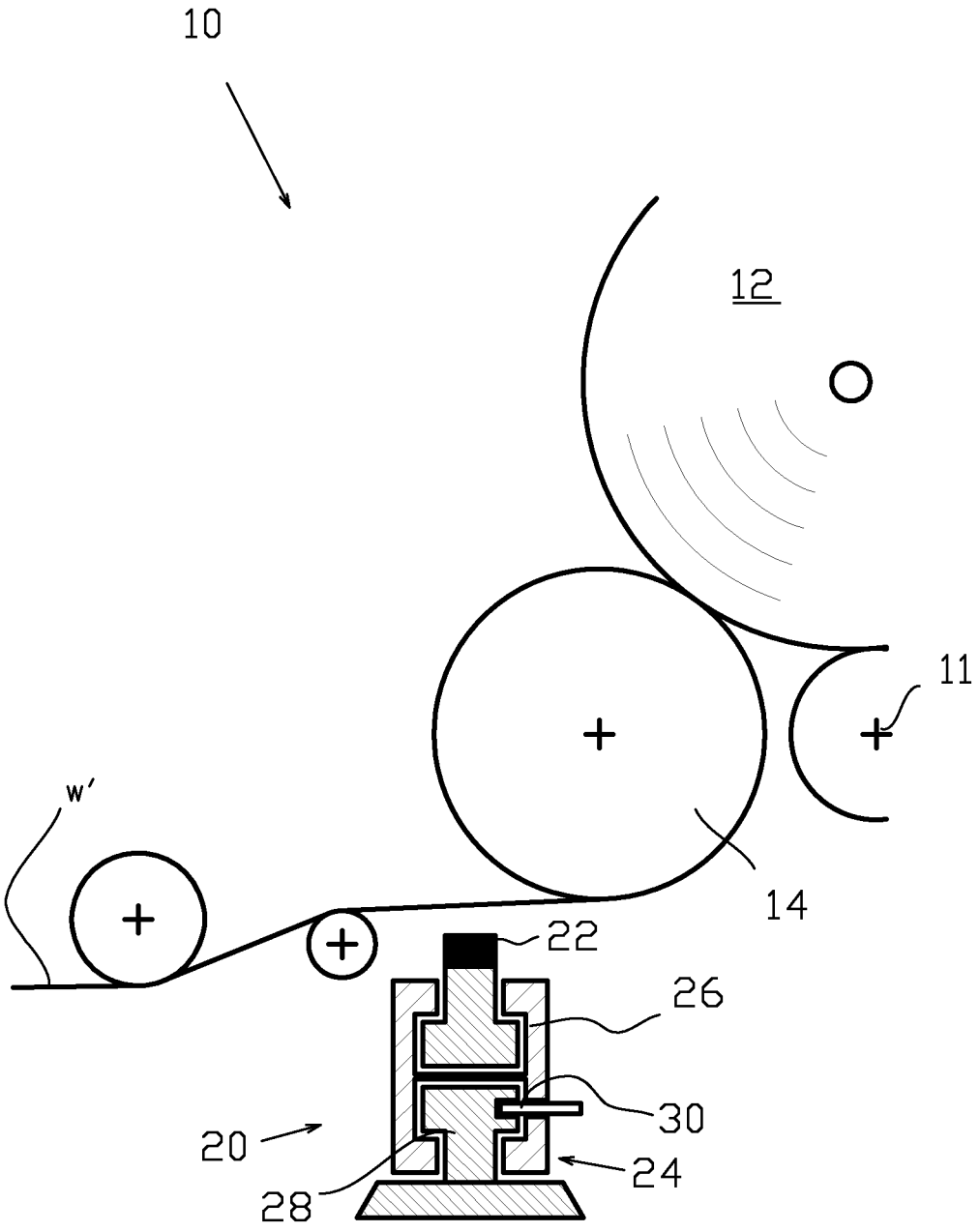
FIG. 1 shows schematically a winding section in a slitter winder for a fibrous web according to an embodiment of the invention

FIG. 1 shows schematically a winding section 10 in a slitter winder for a fibrous web. The FIG. shows a drum reel-up, where web reels 12 to be wound from partial webs w' are formed supported by a drum 14 and support belts 11. The support belts are represented only by one part of a single support belt. The type of the winding section may also be different.

After the winding of each set, a fastening means, preferably an adhesive, attaching the web tail to the reel is passed onto the underside of the partial webs the underside facing the inside of the reel. For this purpose, there is an apparatus 20 arranged in conjunction with the winding section of the slitter winder for bringing the fastening means onto the surface of each partial web. The fastening means may be, for instance, a double-sided tape, but glue is particularly advantageous in practice. Since the fastening means is preferably an adhesive, the apparatus may also be called a gluing device 20 in this connection. The gluing device comprises an applicator head 22 for applying the adhesive, which applicator head is arranged to move substantially in a cross-direction with respect to the travel direction of the web, across the partial webs w' for passing the adhesive onto the web surface. The gluing device 20 comprises a first guiding structure 26, in which the applicator head 22 is arranged. The applicator head can be moved along the first guiding structure 26 across the partial webs. Thus, the adhesive may be passed onto the surface of each partial web by means of the applicator head. The adhesive is passed onto the web surface at the final stage of the winding in order to fasten the tail of the cut-off web onto the web surface and/or to fasten the new web to the core base, such as a sleeve, of the reel.

Support members 24 are arranged in conjunction with the winding section, by means of which members the gluing device 20 is arranged movably substantially in cross-direction with respect to the winding section. In this manner, the gluing device 20 can be moved from beneath/inside the winding section 10 to the side thereof for maintenance and thereby the maintenance work can be performed much easier. Locking members 30 are also arranged in conjunction with the apparatus, by means of which members the first guiding structure 26 of the apparatus can be locked at least into its operating position in the slitter winder. The locking members may be embodied in several ways and FIG. 1 shows, by the way of example, a solution, in which the parts are interlocked by means of a separate pin.

FIG. 1 shows the apparatus in its operating position, i.e. beneath the winding section 10. If the aim is, for instance, to perform maintenance work, the locking members 30 can be released and the apparatus 20, i.e. the gluing device, can be moved away from beneath the winding section to its maintenance position. Then, the gluing device is located, at least for the main part, if not totally, outside the winding section and thereby also outside the slitter winder.

Figure 2:
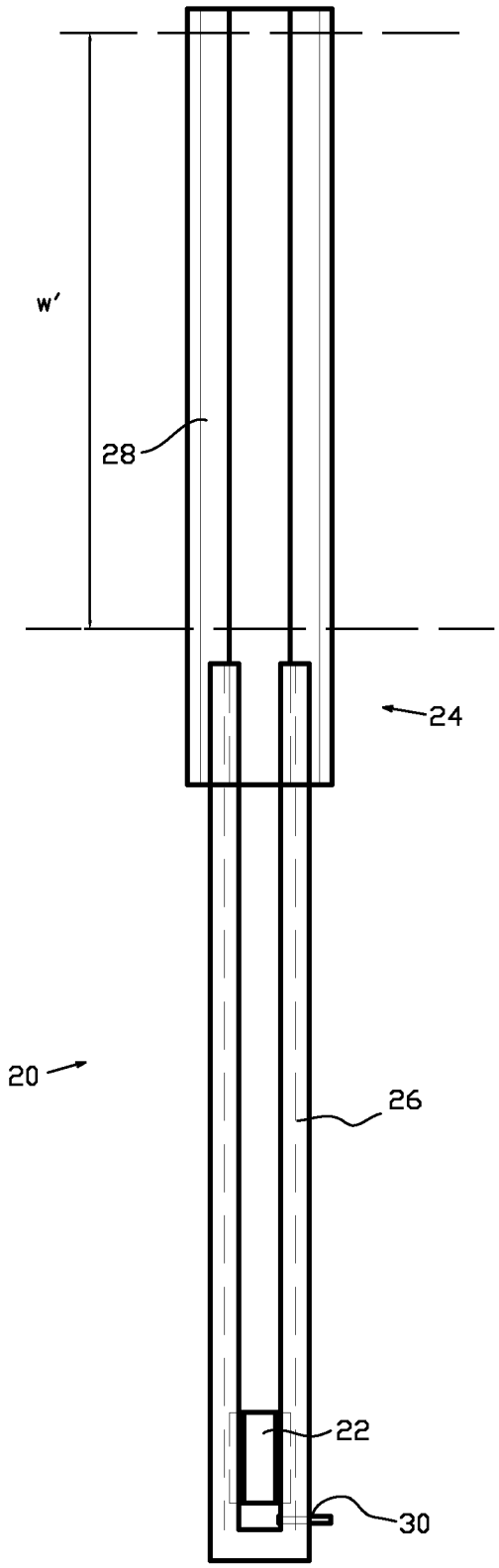
FIG. 2 shows an apparatus according to an embodiment of the invention in the maintenance position.

FIG. 2 shows an apparatus 20, i.e. a gluing device, from above, when it is brought to its maintenance position. The support members, by means of which the gluing device 20 is arranged movably substantially in a cross-direction with respect to the winding section, comprise in the embodiments of FIGS. 1 and 2 a guiding structure, i.e. a second guiding structure 28. The first guiding structure 26, in which the applicator head 22 is arranged, is adapted in conjunction with the second guiding structure 28 so that it can be moved to the maintenance position guided by the second guiding structure. As shown in FIG. 2, the second guiding structure is arranged below the winding section, in the region of the partial webs w'. In the operating position, the gluing device is by means of the second guiding structure arranged below the winding section 10.

In this way, the maintenance and cleaning of the device is significantly facilitated.

An additional advantage of the invention is the fact that, in practice, inside the slitter winder neither access is required around the gluing device, nor space to a larger extent than the gluing device itself requires. Thus, the present invention provides a method for modernizing a slitter winder, which method makes it possible to adapt a gluing device also in a very small space.

The existing slitter winder for a fibrous web comprises an unwinding section for a reel of fibrous web, a slitting section and a winding section for partial webs, where an old gluing device is arranged along the travel path of the web between the slitter section and the winding section for passing an adhesive onto the surface of each partial web facing the inside of the reel in order to fasten the web tail to the surface of the finished reel of partial web. The gluing device comprises in the slitter winder a first guiding structure extending essentially in a cross-direction across the partial webs and an applicator head arranged to move across the partial webs with respect to the guiding structure for bringing a fastening means onto the web surface. In the method, said gluing device is removed from the slitter winder, the structure of the gluing device is modified and the gluing device is re-installed in the slitter winder. The modification of the gluing device comprises that support members, by means of which the first guiding structure of the apparatus can be arranged movably substantially in a cross-direction with respect to the slitter winder, are attached to the apparatus. The gluing device is re-installed in the slitter winder by means of said support members.

Optionally, instead of modifying the structure of the gluing device, the device may be replaced with a totally new gluing device comprising support members, by means of which the gluing device is installed in the slitter winder and by means of which the guiding structure of the apparatus can be arranged movably substantially in a cross-direction with respect to the slitter winder.

Figure 3:
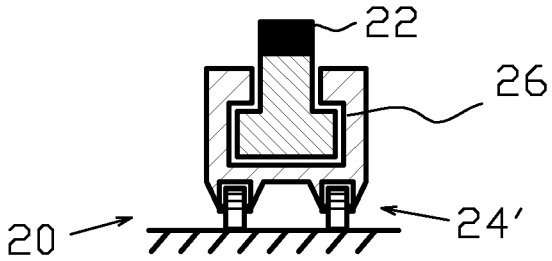
FIG. 3 shows an apparatus according to an embodiment of the invention for bringing a fastening means onto the surface of a partial web.

The structure of the gluing device is such that it can be pulled to the side of the slitter winder for maintenance without any special dismantling. The apparatus moves sideways for instance on a guide and/or wheels 24', as illustrated in FIG. 3. The gluing device can be manually movable or an actuator may be arranged for it. Various devices related to the applicator head, such as glue pumps, valves etc., move along with the gluing device. The devices are connected by means of quick couplings, whereby the moving to the maintenance position is as simple as possible.

Figure 4:
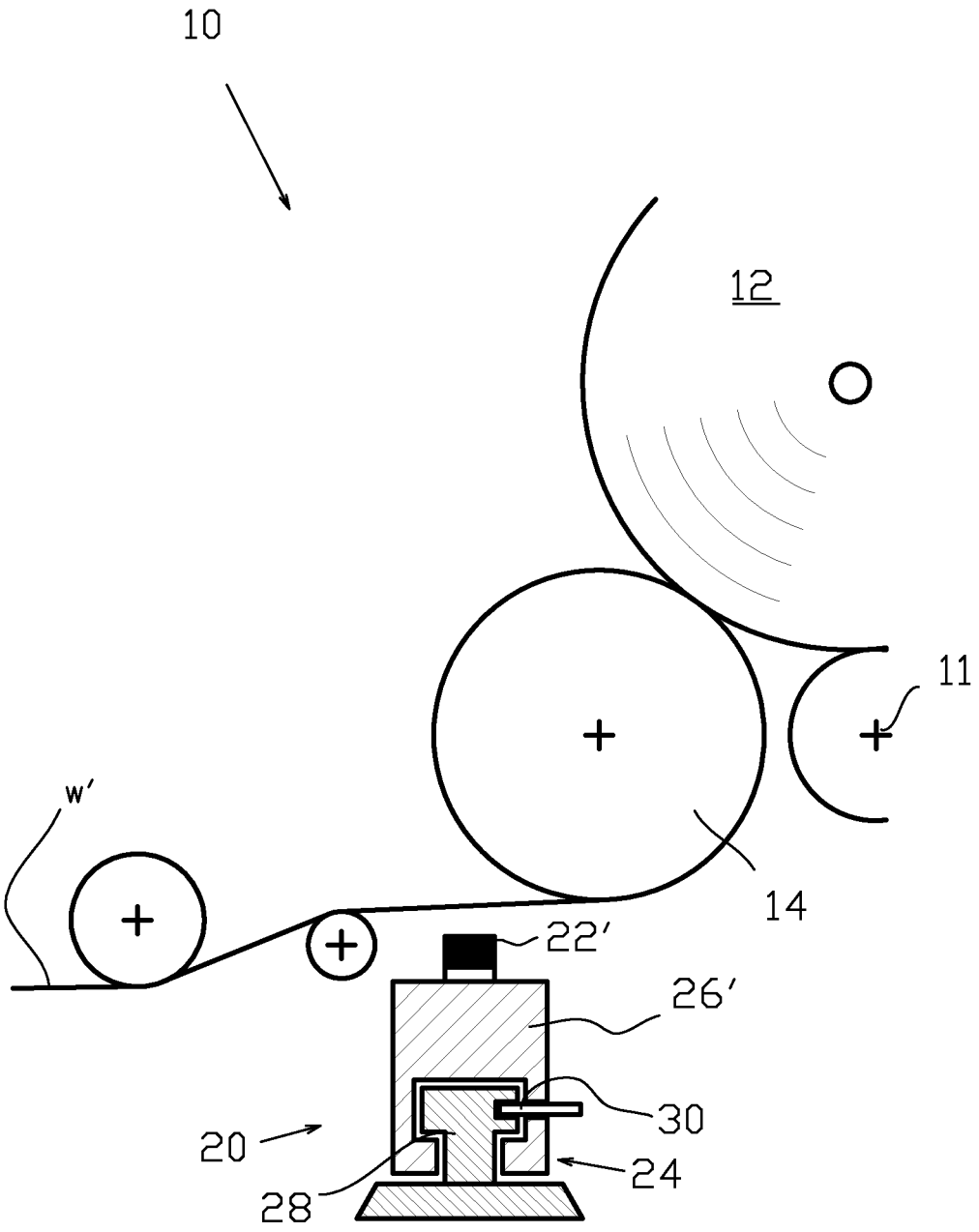
FIG. 4 shows schematically a winding section in a slitter winder for a fibrous web according to an embodiment of the invention.
Figure 5:
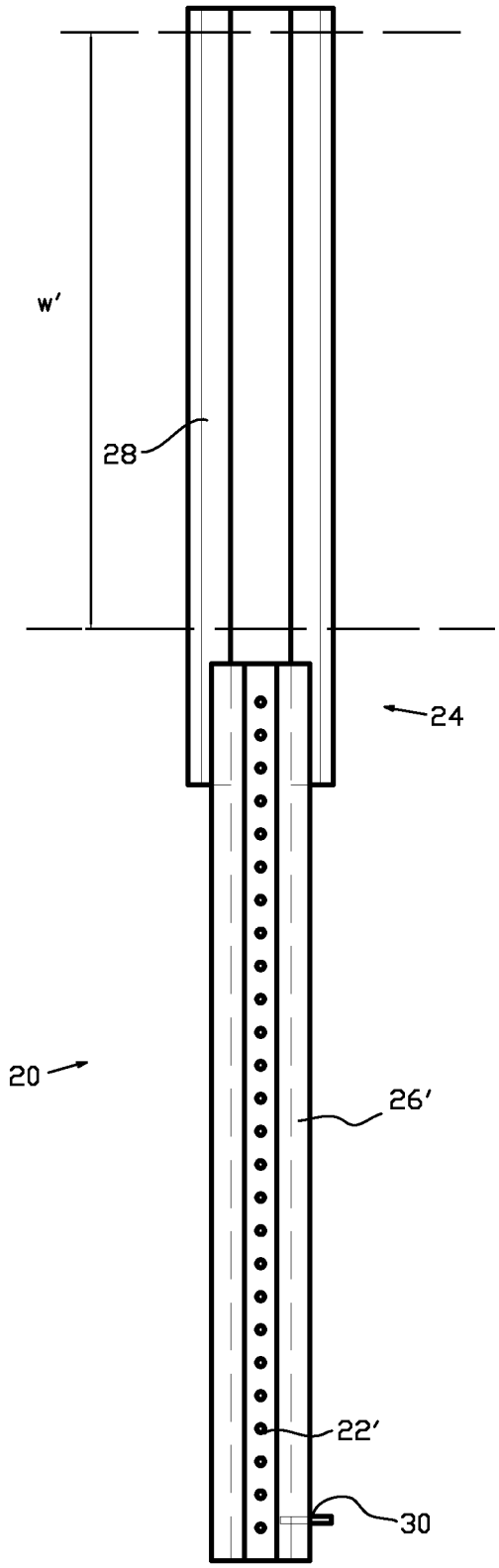
FIG. 5 shows the apparatus according to FIG. 4 in the maintenance position.

In FIG. 4 the winding section in a slitter winder for a fibrous web according to one embodiment is shown. FIG. 4 shows schematically a winding section 10 in a slitter winder for a fibrous web. FIG. 4 also shows a drum reel-up, in which the web reels 12 to be wound from partial webs w' are formed supported by a drum and support belts 11. The embodiment in FIG. 4 corresponds to the one shown in FIG. 1 in other respects, but the applicator head 22' in FIG. 4 is a stationary device extending across all the partial webs'. The applicator head 22' is arranged at a stationary beam 26' or the like, which again is arranged movably substantially in a cross-direction with respect to the winding section 10. This is, as well, performed by means of support members 24, such as a guiding structure 28. This is shown in FIG. 5 seen from above in the maintenance position. Especially in the case of this kind of an applicator head that extends across the whole region of the partial webs, the advantages of the invention become particularly apparent. When moved to the maintenance position, the applicator head 22' and its nozzles for adhesive are easily maintained.

It is to be noted that only a few most advantageous embodiments of the invention are described in the above. Thus, it is clear that the invention is not limited to the above-described embodiments, but may be applied in many ways within the frame of the appended claims. The features described in conjunction with the different embodiments may be used in conjunction with other embodiments as well and/or various combinations of the described features may be made within the frame of the basic idea of the invention, if so desired, and if technical feasibility for this exists.

The invention claimed is:

1. An apparatus in a slitter winder, comprising:

support members mounted in a cross direction of the slitter winder and across a web path defined by a plurality of partial webs;

a device for placing a fastening onto a surface of the plurality of partial webs, the device mounted to the support members for movement in the cross direction;

an applicator head mounted on the device, the applicator head arranged to apply the fastening onto the surface of the plurality of partial webs;

wherein that the device is movable on the support members in substantially the cross direction, from an operating position within the web path to a maintenance position not within the web path; and wherein the device comprises a structure that can be separated into two parts, which are arranged to be moved to different sides of the slitter winder on the support members.

2. The slitter winder of claim 1 further comprising:

wherein the applicator head is mounted for movement substantially in the cross-direction with respect to the winding section on a first support member, and wherein the first support member is at least part of the device, which is mounted for movement on the support members.

3. The winding section of claim 1 further comprising a locking member arranged in conjunction with the apparatus which locks the apparatus in a operating position.

4. The winding section of claim 2 wherein the apparatus has a plurality of support wheels mounted on the first support member which ride on the support members.

5. The winding section of claim 2 wherein the support members have a plurality of support wheels by which the first support member is carried and moved on the support structures.

6. The winding section of claim 1 wherein the fastening is an adhesive and wherein the applicator head is provided with supply equipment for the adhesive.

7. The winding section of claim 2 wherein the applicator head is fixedly mounted to the device mounted for movement to the support structures.

8. A slitter winder for a fibrous web, wherein the fibrous web is divided into a plurality of partial webs, the slitter winder comprising:

a winding section;

an apparatus for placing a fastening onto the surface of each partial web, the apparatus being arranged along a travel path of the web before the winding section, which apparatus further comprising:

an applicator head, which is arranged for applying the fastening onto the surface of each partial web;

wherein the apparatus for placing a fastening onto the surface of each partial web is mounted to support members for movement substantially in a cross-direction with respect to the winding section so that the apparatus for placing the fastening onto the surface of each partial web is movable from an operating position across the travel path of the web, and a maintenance position not across the travel path of the web; and wherein the apparatus comprises a structure that can be separated into two parts, which are arranged to be moved to different sides of the slitter winder on the support members when the apparatus is in the maintenance position.

9. The slitter winder of claim 8 further comprising:

wherein the applicator head is mounted for movement substantially in the cross-direction with respect to the winding section on a first support member, and wherein the first support member is at least part of the apparatus, which is mounted for movement on the support members.

10. The winding section of claim 8 further comprising a locking member arranged in conjunction with the apparatus which locks the apparatus in the operating position.

11. The winding section of claim 8 wherein the apparatus has a plurality of support wheels mounted on the apparatus which ride on the support members.

12. The winding section of claim 8 wherein the support members have a plurality of support wheels by which the apparatus is carried and moved on the support structures.

13. The winding section of claim 8 wherein the fastening is an adhesive and wherein the applicator head is provided with supply equipment for the adhesive.

14. The winding section of claim 8 wherein the applicator head is fixedly mounted to the apparatus mounted for movement to the support structures.

15. A slitter winder for a fibrous paper web in a paper machine, wherein the fibrous paper web is divided into a plurality of partial paper webs, the slitter winder comprising:

a winding section;

an apparatus for placing a fastening onto the surface of each partial paper web, the apparatus being arranged along a travel path of the paper web before the winding section, which apparatus further comprising:

an applicator head, which is arranged for applying the fastening onto the surface of each partial paper web;

wherein the applicator head is mounted for movement to a first support member which is arranged for movement substantially in a cross-direction with respect to the winding section, and wherein the first support member is mounted to a second support structure extending in the cross-direction so that the first support member and the applicator head is movable on the second support member from an operating position across the travel path of the paper web, to a maintenance position not across the travel path of the paper web; and wherein the second support member has a plurality of support wheels by which the first support member is carried and moved on the second support structure.

16. The winding section of claim 15 wherein the fastening is an adhesive and wherein the applicator head is provided with supply equipment for the adhesive.

* * * * *